US005537849A

United States Patent [19]

Kawakami et al.

[11] Patent Number: 5,537,849

[45] Date of Patent: Jul. 23, 1996

[54] CONTINUOUS DRY DRAWING METHOD AND APPARATUS THEREFOR

[75] Inventors: Heijiro Kawakami; Kozo Katsube; Yasuyuki Kanesada; Kohro Takatsuka; Katsuyuki Sadakane, all of Kobe, Japan

[73] Assignee: Kabushiki Kaisha Kobe Seiko Sho, Kobe, Japan

[21] Appl. No.: 347,238

[22] Filed: Nov. 23, 1994

[30] Foreign Application Priority Data

Nov. 29, 1993 [JP] Japan ..... 5-298448
Sep. 16, 1994 [JP] Japan ..... 6-222071

[51] Int. Cl.[6] ..... B21B 45/02; B21C 23/24

[52] U.S. Cl. ..... 72/43; 72/41; 72/46

[58] Field of Search ..... 72/39, 40, 41, 72/42, 43, 44, 46

[56] References Cited

U.S. PATENT DOCUMENTS 377,000 1/1888 Withington ..... 72/40
3,961,511 6/1976 Wolfe .
4,464,922 8/1984 Pamplin et al. ..... 72/42
4,615,195 10/1986 Vogel et al. ..... 72/43
5,079,939 1/1992 Shook ..... 72/43

FOREIGN PATENT DOCUMENTS 9212042 1/1993 Germany .
2057321 4/1981 United Kingdom .

*Primary Examiner*—Lowell A. Larson
*Assistant Examiner*—Rodney A. Butler
*Attorney, Agent, or Firm*—Oblon, Spivak, McClelland, Maier & Neustadt

[57] ABSTRACT

Disclosed is a method of drawing a metal wire to a specified diameter using a continuous dry drawing apparatus including a plurality of die units disposed in series, each of the die unit being composed of a dry lubricant unit for applying a dry lubricant on the surface of a metal wire and a die provided on the downstream side of the dry lubricant unit, the method comprising an intermediate coating process of forming a coating film on the surface of the metal wire for enhancing the picking-up of a dry lubricant for subsequent die-drawing, in at least one of the spaces between adjacent die units. With this method, seizure of the die is prevented and the drawing speed is significantly enhanced.

19 Claims, 11 Drawing Sheets

CONTINUOUS DRY DRAWING METHOD AND APPARATUS THEREFOR

BACKGROUND OF THE INVENTION

1. Field of the Invention

The present invention relates to a continuous dry drawing for a metal wire such as a steel wire and an apparatus therefor.

2. Description of the Related Art

A technique of drawing a metal wire to a specified diameter through dies is generally classified into a dry type method using a powder lubricant mainly containing metal soap and a wet type method using a liquid oil or water-soluble lubricant.

The important subject of the dry drawing method is the improvement of the drawing speed and the life of a die. To achieve this subject, lubrication and cooling techniques are required.

A cooling technique has been disclosed, for example in Examined Japanese Patent Publication No. SHO 51-31034.

As shown in FIG. 11, in drawing a metal wire 80 to a specified diameter through a plurality of dies 81, the prior art method includes the steps of removing scales on the surface of a metal wire in a pickling process; supplying the metal wire 80 subjected to a phosphate treatment from a supply stand; applying, on the surface of the metal wire, a dry lubricant 82 composed of solid metal soap or the like which is provided on the inlet side of each die; and passing the metal wire through each die 81; wherein a cooling unit 83 is provided on the downstream side of each die 81 for simultaneously cooling the die 81 and the metal wire 80 thereby improving the drawing speed.

A lubricating technique has been disclosed, for example in Examined Japanese Patent Publication No. SHO 45-9054, wherein a powder lubricant is pressed onto the surface of a wire by a roller to increase the adhesive force of the lubricant, thus improving the lubricating ability, and thereby enhancing the life of a die.

However, even by use of the above cooling technique combined with the above lubricating technique, there is a limitation in improving the drawing speed and the life of a die.

The limitation is mainly due to the lack of lubrication.

The diameter of a wire is reduced as the drawing proceeds, and the surface area per unit weight of the metal wire is increased linearly with the reduction ratio. Because of this increase in the surface area, the coating film formed in a drawing pre-treatment becomes thin. This coating film acts to enhance the picking-up of a dry lubricant, and accordingly, as the coating film becomes thin, the picking-up of the dry lubricant becomes insufficient, resulting in poor lubrication.

Also, part of the, coating film formed in the drawing pre-treatment is scraped as the metal wire passes through a plurality of dies, so that the picking-up of the dry lubricant becomes insufficient, resulting in poor lubrication.

Thus, when the total reduction ratio or the drawing speed is more than a specified value, the coating film is significantly deteriorated, which makes it difficult to perform the drawing.

SUMMARY OF THE INVENTION

An object of the present invention is to provide a continuous dry drawing method capable of improving the drawing speed and the life of a die without generation of poor lubrication, and an apparatus therefor.

In the prior art methods, for drawing of a metal wire, the coating film is applied only once before the continuous drawing. This single pre-treatment has the problem that the number of dies through which the metal wire can pass is limited. On the contrary, the present invention provides a dry lubricating method, wherein at least one intermediate coating process for supplying a lubricating film is performed during the continuous drawing. This makes it possible to prevent the seizure of the die, and hence to extremely improve the drawing speed as compared with the conventional method.

To achieve the above object, according to a first aspect of the present invention, there is provided a method of drawing a metal wire to a specified diameter using a continuous dry drawing apparatus including a plurality of die units disposed in series, each of the die units being composed of a dry lubricant unit for applying a dry lubricant on the surface of a metal wire and a die provided on the downstream side of the dry lubricant unit, the method comprising an intermediate coating process of forming a coating film on the surface of the metal wire for enhancing the picking-up of a dry lubricant for subsequent die-drawing, in at least one of the spaces between adjacent die units.

Additionally, in the present invention, the metal wire to be drawn is not limited to that having a circular cross-section, and it may include that having a modified cross-section.

The intermediate coating process may include a process of applying a coating liquid on the surface of the metal wire, and a process of drying the coating liquid applied on the metal wire.

The applying process may be performed by passing the metal wire through the coating liquid, or by spraying the coating/liquid on the surface of the metal wire.

The drying process may be performed by drying the coating liquid using the working heat of the metal wire itself.

The intermediate coating process may be performed directly after passing the metal wire through the die or may be performed at a specified distance downstream of the die.

The intermediate coating process may be performed after cooling the metal wire.

In the intermediate coating process, wiping of the metal wire may be performed such that the thickness of the coating liquid applied on the surface of the metal wire is made uniform, after passing the metal wire in the coating liquid or after spraying the coating liquid on the metal wire.

The coating film may be formed from a solution mainly containing a water-soluble inorganic salt. Said solution may be circulated.

To achieve the above object, according to a second aspect of the present invention, there is provided a continuous dry drawing apparatus comprising a plurality of die units disposed in series, each of the die units being composed of a dry lubricant unit for applying a dry lubricant on the surface of a metal wire and a die provided on the downstream side of the dry lubricant unit, wherein the apparatus has an intermediate coating unit provided in at Least one of the spaces between adjacent die units for forming a coating film on the surface of the metal wire for enhancing the picking-up of a dry lubricant for subsequent die-drawing.

The intermediate coating unit may comprise a coating liquid dipping bath having a structure of allowing the metal wire to pass through the coating liquid, or a coating liquid spraying unit for spraying the coating liquid on the metal wire.

The coating liquid dipping bath may be provided at the outlet of the die unit, or may be provided at a specified distance downstream of the outlet of the die unit. Moreover, in place of the coating liquid dipping bath, a coating liquid spraying unit may be provided at a specified distance downstream of the outlet of the die unit.

The intermediate coating unit may also include a wiping unit for wiping the metal wire provided downstream from the coating liquid dipping bath or the coating liquid spraying unit.

A cooling unit for cooling the metal wire may be provided between the cutlet of the die unit and the coating liquid dipping bath or the coating liquid spraying unit.

The coating liquid dipping bath or the coating liquid spraying unit may be connected to a coating liquid circulating/supplying unit for circulating and supplying the coating liquid.

According to the present invention, using the intermediate coating unit provided in at least one of the spaces between adjacent die units, a coating film for enhancing the picking-up of a dry lubricant effective for subsequent die-drawing is formed on the surface of the metal wire, so that the picking-up of the dry lubricant is improved on the downstream side from the intermediate coating unit, and so that when the wire passes through each die, cases of poor lubrication are prevented. Accordingly, it becomes possible to improve the drawing speed and to prolong the life of the die.

In general, in the drawing process, scales on the surface of a metal wire are removed prior to drawing, and then the coating film for enhancing the picking-up of a dry lubricant is applied to the metal wire as the drawing pre-treatment. The coating film formed in the drawing pre-treatment is, as described above, made thin or scraped off as the drawing proceeds, and the picking-up of the lubricant on the metal wire is reduced.

However, in the present invention, since the coating film effective for subsequent die-drawing is formed on the surface of a metal wire in the intermediate coating process, the deterioration of the coating film formed in the drawing pre-treatment can be compensated for.

In the case where the intermediate coating process is performed by passing the wire through the coating liquid or spraying the coating liquid on the surface of the wire, the wire is cooled by the coating liquid, thus eliminating the necessity to provide an additional cooling unit.

The coating film applied on the metal wire must be dried before applying the dry lubricant for subsequent die-drawing. However, the wire passing through a die becomes heated to a high temperature, and thereby the coating liquid applied on the wire is dried by this working heat of the metal wire, which eliminates the necessity to provide an additional drying unit.

By performing the intermediate coating process directly after passing the wire through the die or at a specified distance downstream of the die, drying functions are more effectively achieved.

By performing the intermediate coating process at a location separated from the die by a specified distance, it becomes possible to prevent the contamination of the flakes of lubricant into the intermediate coating liquid.

By circulating the coating liquid, the temperature and the concentration of the coating liquid can be easily kept constant, thus making it possible to maintain a stable coating conditions.

By wiping the wire after passing it through the coating liquid or after spraying it with the coating liquid, it becomes possible to make uniform the sticking amount of the coating liquid on the wire, and hence to control the thickness of the coating film. When an excessive coating film is applied on the metal wire, the wire tends to slip up the drawing capstan due to lack of friction and thus causing wire tangling problems during drawing; and when the wire passes through the subsequent die in the state where the drying is insufficient, the lubricity is deteriorated and die seizure will occur. However, the wiping solves these problems.

In addition, by using a coating liquid mainly containing a water-soluble inorganic salt, it becomes possible to reduce the cost as compared with phosphate treatment, and this process proposes the possibility to eliminate the pickling process with generates industrial waste.

DETAILED DESCRIPTION OF THE PREFERRED EMBODIMENTS

Hereinafter, embodiments of the present invention will be described with reference to the drawings.

Embodiment 1

Figure 1:
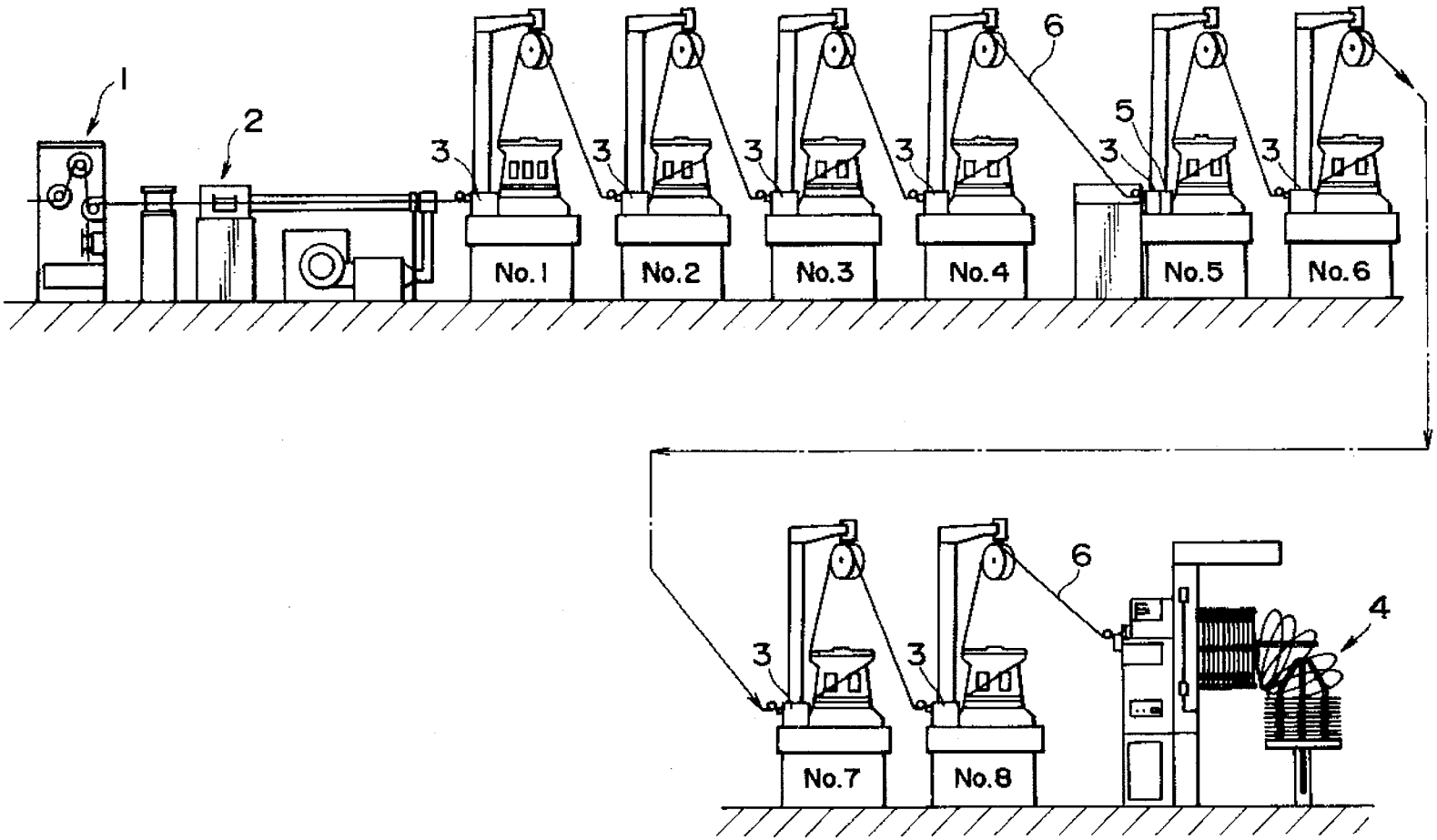
FIG. 1 is a view showing the whole construction of a continuous dry drawing apparatus used in embodiments of the present invention.

Referring to FIG. 1, a continuous dry drawing apparatus of the present invention includes a supply unit (not shown); a descaling unit 1; a drawing pre-treatment unit 2; first to eighth die units 3, 3, . . . disposed in series on the downstream side of the drawing pre-treatment unit 2; and a winding unit 4 provided downstream from the eighth die unit 3. An intermediate coating unit 5 is provided between the fifth and sixth die units 3 and 3, more specifically, directly downstream from the fifth die unit 3.

The descaling unit 1 is intended to remove scales produced on the surface of a metal wire 6. In this embodiment, a reverse bending type mechanical descaler is used as the descaling unit 1; however, it may be replaced by a shot blasting unit or the like.

The drawing pre-treatment unit 2 is intended to form a drawing pre-treatment coating film on the surface of the metal wire 6 for assisting the picking-up of a dry lubricant on the metal wire 6. Specifically, in this drawing pre-treatment unit 2, the wire 6 is dipped in a drawing pre-treatment coating liquid and the coating liquid applied on the surface of the wire is dried, thus forming a drawing pre-treatment coating film on the surface of the wire.

The drawing pre-treatment coating liquid mainly contains a water-soluble inorganic salt. For example, it may include a solution mainly containing a sodium salt such as sodium sulfate ($Na_2SO_4$), sodium sulfite ($Na_2SO_3$), sodium metasilicate ($Na_2SiO_3$), sodium orthosilicate ($Na_2SiO_4$), or borax ($Na_2B_4O_7$); a solution mainly containing a potassium salt such as potassium sulfate ($K_2SO_4$), potassium tetraborate ($K_2B_4O_7$), potassium pentaborate ($KB_5O_8$), potassium metaborate ($KB_5O_2$), potassium metasilicate ($K_2SiO_3$), potassium tetrasilicate ($K_2Si_4O_9$), and potassium hydrogen silicate ($KHSi_2O_5$); a solution containing both a sodium salt and a potassium salt; or lime liquid. The coating liquid is pre-heated to a temperature ranging from 40° to 95° C.

A water-soluble resin coating liquid may be applied to drawing for stainless steel wires. In this case, the coating liquid may be at room temperature.

The metal wire 6 supplied from the supply unit (not shown) passes through the descaling unit 1, and then passes through the drawing pre-treatment unit 2. When passing through this drawing pre-treatment unit 2, the surface of metal wire 6 has a drawing pre-treatment coating film mainly containing a water-soluble inorganic salt formed thereupon. The wire 6 is thus drawn to a specified wire diameter by way of the first to fifth die units 3, 3, . . . drawing pre-treatment unit 2, the intermediate coating unit 5, and the sixth to eighth die units 3, 3, and 3; and it is wound using the winding unit 4.

Figure 2:
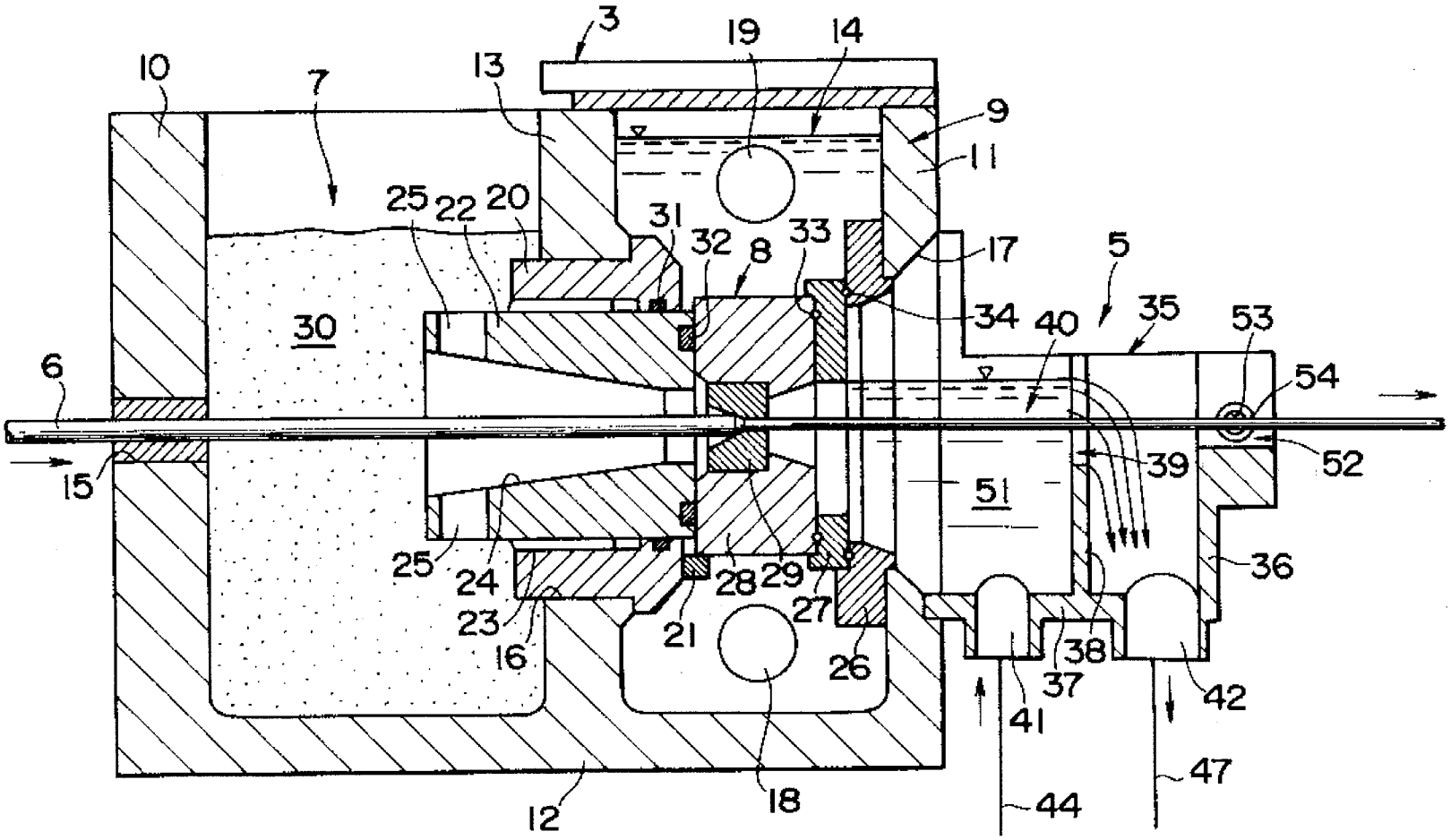
FIG. 2 is a sectional view of a die unit and an intermediate coating unit according to a first embodiment of the present invention.

FIG. 2 shows the details of the fifth die unit 3 and the intermediate coating unit 5 provided on the downstream side from the fifth die unit 3. In addition, the first to eighth die units 3, 3, . . . have the same structure except that they do not have an intermediate coating unit 5.

The die unit 3 includes a dry lubricant unit 7, and a die 8 provided on the downstream side of the unit 7. The dry lubricant unit 7 and the die 8 are provided in a die holder 9.

The die holder 9 is formed in a box shape with the upper portion opened, which has a front and rear walls 10 and 11, right and Left side walls, and a bottom wall 12. The interior of the die holder 9 is partitioned into front and rear chambers by an intermediate wall 13. The front chamber (wire going-in side) constitutes the dry lubricant unit 7, and the rear chamber (wire going-out side) constitutes a die cooling chamber 14.

A wire going-in hole 15, a mounting hole 16 and a wire going-out hole 17 are respectively provided on the front wall 10, intermediate wall 13 and rear wall 11 in such a manner as to be coaxial with the drawing line. A cooling water supply port 18 is provided on the lower portion of the side wall of the die cooling chamber 14, and a cooling water discharge port 19 is provided on the upper portion thereof.

A die fixing outer cylinder 20 is securely fitted in the mounting hole 16 provided on the intermediate wall 13. A die positioning/supporting portion 21 is provided on the lower end portion of the die fixing outer cylinder 20 in such a manner as to project on the cooling chamber side.

A die fixing inner cylinder 22 is coaxially screwed in the die fixing outer cylinder 20 by way of a screw portion 23. The die fixing inner cylinder 22 has a coaxial taper hole 24 on the inner peripheral side. A turning operational hole 25 is provided in the die fixing inner cylinder 22 on the dry lubricant unit side in such a manner as to pass through the die fixing inner cylinder in the radial direction. By inserting a tool through the turning operational hole 25 and turning the die fixing inner cylinder 22, the die fixing inner cylinder 22 is moved in the axial direction.

A mounting ring 26 is coaxially mounted in the wire going-out hole 17 provided on the rear wall 11. A die positioning/holding ring 27 is coaxially mounted on the mounting ring 26.

The die 8 is fixedly held between the holding ring 27 and the die fixing inner cylinder 22, and is further supported by the die positioning/supporting portion 21. Namely, in the cooling chamber 14, the die is positioned and fixed in a replaceable manner by the inner cylinder 22 and the die positioning/holding ring 27.

The die 8 includes a die main body 28, and a cemented carbide made chip 29 fixed in the die main body 28 by shrinkage-fit.

The dry lubricant unit 7 of the die holder 9 is filled with a dry lubricant 30 (for example, Na based dry lubricant) in the solid state (for example, in the form of powder). When the metal wire 6 passes through the lubricant 30, the lubricant 30 becomes applied on the surface of the metal wire 6. The dry lubricant 30 may include a powder lubricant containing a metal soap such as calcium stearate, inorganic material, sulfur, graphite, or molybdenum disulfide.

The die cooling chamber 14 is supplied with cooling water from the cooling water supply port 18. The cooling water acts to cool the die 8 from the outer peripheral surface of the die 8, and is discharged from the discharge port 19.

In addition, to prevent the leakage of the die cooling water from the cooling chamber 14 to the die 8 and the dry lubricant unit 7, sealing materials 31, 32, 33 and 34 are respectively provided, between the die fixing inner cylinder 22 and the outer cylinder 20, between the end surface of the die inner cylinder 22 and the end surface of the die 8, between the end surface of the die 8 and the holding ring 27, and between the holding ring 27 and the mounting ring 26.

The intermediate coating unit 5 comprises a coating liquid dipping bath 35 mounted on the rear wall 11 of the die holder 9. The coating liquid dipping bath 35 is provided at the outlet of the die 8.

The coating liquid dipping bath 35 is formed in a box-shape with the front and upper sides opened, which includes right and left walls, a rear wall 36 and a bottom wall 37. A bulkhead 38 is provided in this coating liquid dipping bath 35. A U-shaped recessed portion 39 is formed on the upper surface of the bulkhead 38 so as to be coaxial with the drawing line. The front opening portion of the coating liquid dipping bath 35 is connected with the wire going-out hole 17 provided in the rear wall 11 of the die holder 9 in such a manner as to be communicated therewith. The front chamber at the upstream side of the bulkhead 38 is a coating liquid chamber 40 for storing a coating liquid, and the rear chamber on the downstream side of the bulkhead 38 is an over-flow chamber. A coating liquid supply port 41 is provided on the bottom wall 37 of the coating liquid chamber 40, and a coating liquid discharge port 42 is provided on the bottom wall 37 of the over-flow chamber.

Figure 3:
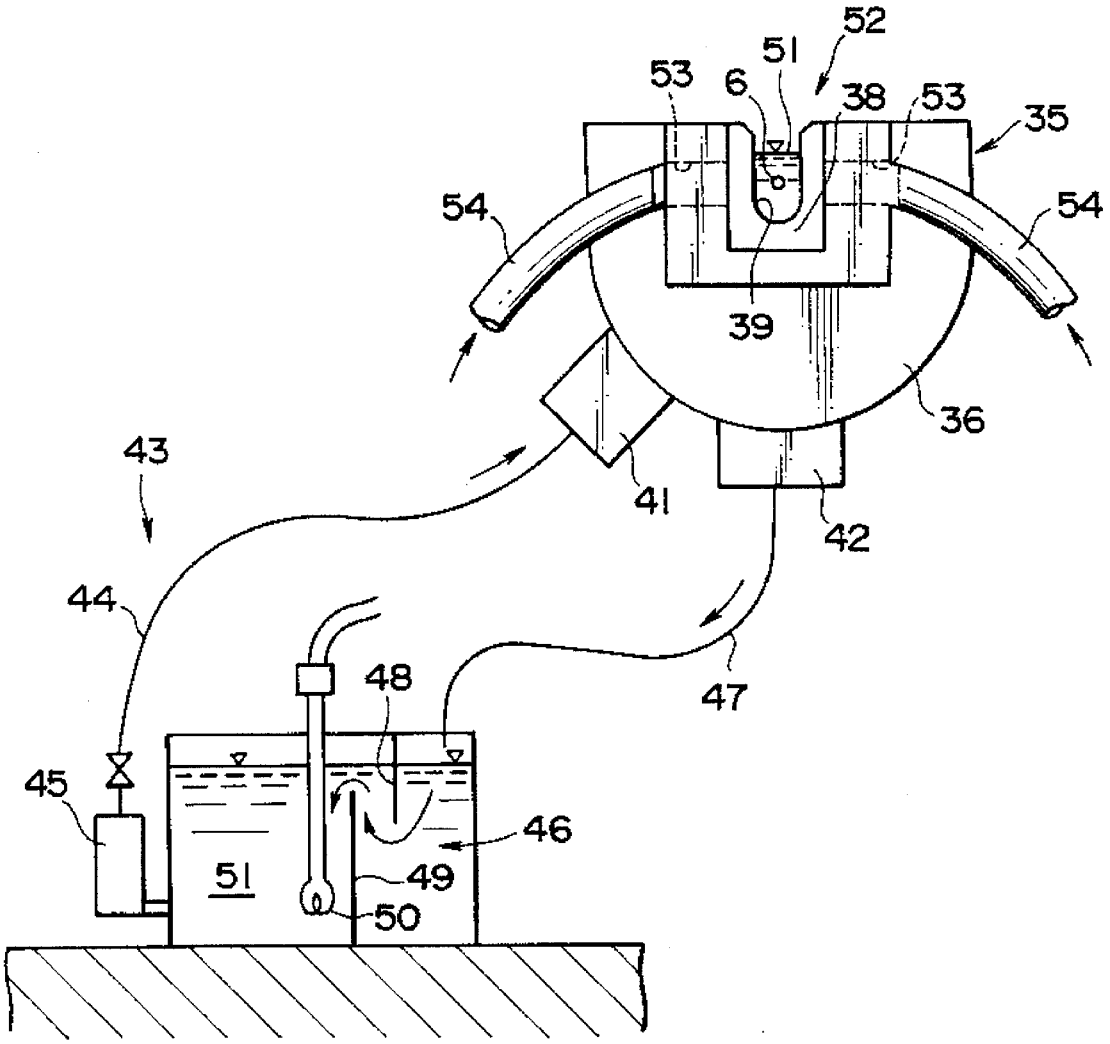
FIG. 3 is a diagram showing the circulation of a coating liquid in a coating liquid recovery/supply unit provided in the apparatus shown in FIG. 2.

As shown in FIG. 3, a coating liquid circulating/supplying unit 43 for circulating/supplying a coating liquid is connected to the coating liquid dipping bath 35. The coating liquid circulating/supplying unit 43 includes a supply pipe 44 connected to the coating liquid supply port 41, a circulating pump 45 connected to the pipe 44, a coating liquid tank 46 connected to the pump 45, and a discharge pipe 47 for connecting the coating liquid discharge port 42 to the coating liquid tank 46.

In the coating liquid tank 46, upper and lower bulkheads 48 and 49 are provided, and a heater 50 and a mixer (not shown) are disposed. In addition, a cooler (not shown) is provided to prevent the reduction of the cooling effect of the wire due to the excessive increase in temperature of the coating liquid 51 in the tank 46.

The coating liquid 51 stored in the coating liquid tank 46 is supplied from the circulating pump 45 to the coating liquid chamber 40 by way of the supply pipe 44 and the supply port 41. The coating liquid 51 in the coating liquid chamber 40 over-flows from the U-shaped recessed portion 39 of the bulkhead 38, and it is returned from the discharged port 42 to the coating liquid tank 46 by way of the discharge pipe 47.

In the coating Liquid tank 46, sludge contained in the coating liquid thus returned is separated by floatation and precipitation by the upper and lower bulkheads 48 and 49, thus purifying the coating liquid 51.

The heater 50 and the mixer (not shown) are intended to prevent the deposition of crystals from the purified coating liquid 51 and the precipitation thereof.

As the coating liquid 51, there may be used a solution of borax (sodium borate), lime liquid or a solution containing the same water-soluble inorganic salt as that used for the above drawing pre-treatment coating liquid. When the coating liquid 51 having the same composition as that of the drawing pre-treatment coating liquid is used, it is kept at a temperature between 40° and 95° C. by the heater 50.

A wiping unit 52 for wiping the metal wire such that the thickness of the coating film is uniform is provided on the rear wall 36 of the dipping bath 35. Specifically, compression air blow-out ports 53 are provided on both the side surfaces of the wire passing hole provided on the rear wall 36, and a compression air supply pipe 54 is connected to the blow-out ports 53.

Compressed air is jetted from a blow-out port 53 to the metal wire 6 to wipe the coating liquid 51 stuck on the metal wire 6, so that the thickness of the coating liquid 51 stuck on the metal wire 6 is made uniform, thus preventing excessive application of the coating liquid 51. After wiping, the coating liquid 51 is dried by the working heat of the metal wire itself. Thus, a metal wire 6 formed with the excellent coating film is passed through to the next die unit 3.

Figure 4:
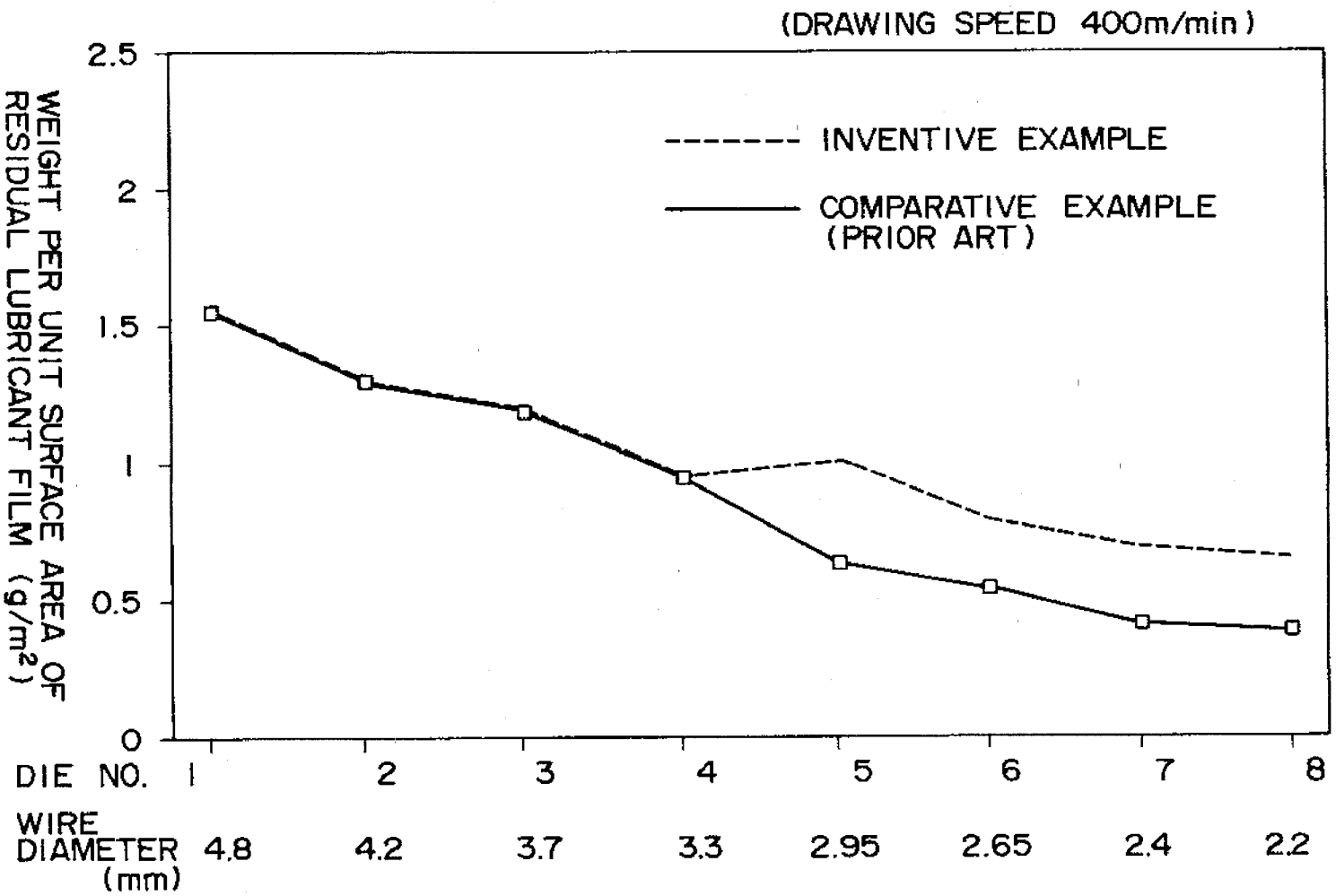
FIG. 4 is a graph for comparing the present invention with the prior art with regard to the amount of residual lubricant film.

Experiments were made using the above apparatus under the following conditions for confirming the effect of the present invention compared with the prior art, which gave the results shown in Table 1 and FIG. 4.

(Experimental Condition)

Kind of Steel: 0.82C carbon steel

Starting Wire Diameter: 5.5 mmø → Finished Wire Diameter: 2.2 mmø

Drawing Pre-treatment: mechanical descaling+ borax coating

Lubricant: Na based dry lubricant

Number of Die Units: 8 (No. 1 to No. 8)

Drawing Speed: 350 to 425 m/min

Inventive Example: intermediate coating unit, located at outlet of Die Unit No. 5 (wire diameter: 2.95 mmø)

Comparative Example (Prior Art): intermediate coating, not applied

TABLE 1

| Drawing speed (m/min) | 350 | 375 | 400 | 425 |
|---|---|---|---|---|
| Comparative example | ○ | X | X | X |
| Inventive example | ○ | ○ | ○ | Δ |

In the Table 1, ○ represents the absence of any seizure of the die; Δ represents the presence of a very slight seizure of the die; and X represents the presence of a seizure of the die.

In this embodiment, at the outlet of the fifth die unit 3, the metal wire 6 is dipped in the coating liquid 51 of the coating liquid dipping bath 35 and is subjected to air wiping by the wiping unit 52; accordingly, the coating liquid 51 stuck on the metal wire 6 is rapidly dried by the working heat of the wire itself and the air wiping.

FIG. 4 is a graph for comparing the inventive example with the comparative example (prior art) with regard to the amount of the coating film containing residual lubricant. As is apparent from FIG. 4, in the comparative example (prior art), the amount of the coating film containing residual lubricant was sequentially reduced in the order from Die Unit Nos. 5 to 8, and it was 0.5 g/m$^2$ or less at each of Die Unit Nos. 7 and 8. As a result, at each of Die Unit Nos. 7 and 8, seizure of the die was generated. On the contrary, in the inventive example, at each of Die Unit Nos. 1 to 8, the amount of the coating film containing the residual lubricant was more than 0.5 g/m$^2$ and there no seizure of the die.

As is apparent from Table 1, the drawing speed in the inventive example was extremely increased as compared with that in the comparative example (prior art). Consequently, it is expected that the drawing speed could be increased by 20 to 30% or more by performing the intermediate coating process at a plurality of locations other than the outlet of the fifth die unit.

In this embodiment, the coating liquid 51, which is composed of a solution of borax or the like, can be uniformly applied on the surface of the wire 6 on which the lubricant 30 remains. The coating liquid 51 stuck on the wire 6 is sufficiently dried just by the working heat of the wire, thus forming a pre-treatment coating film (complex or mixed coating film of the residual lubricant and the coating agent) effective for subsequent die-drawing. In other words, this coating film functions as a carrier of the dry lubricant 30 for subsequent die-drawing.

The coating liquid 51 also has a cooling function because the temperature of the coating liquid 51 in the dipping bath 35 is about 90° C., while the temperature of the wire directly after passing though the die 8 is locally 200° C. or more. This cooling effect of the coating liquid 51 reduces the temperature of the friction surface between the die 8 and the wire 6, and thereby improves the lubricating effect. In this way, the coating liquid 51 exhibits a double lubricating and cooling effect, which enables the improvement in the die seizure critical speed.

Embodiment 2

In this embodiment, a continuous dry drawing apparatus having first to eighth die units 3, 3, . . . is provided with intermediate coating units 5 at the outlet sides of the second, fourth and sixth die units 3, 3 and 3.

In addition, the apparatus used in this embodiment is the same as the first embodiment shown in FIG. 2 except for the structure of the wiping unit 52.

Figure 5:
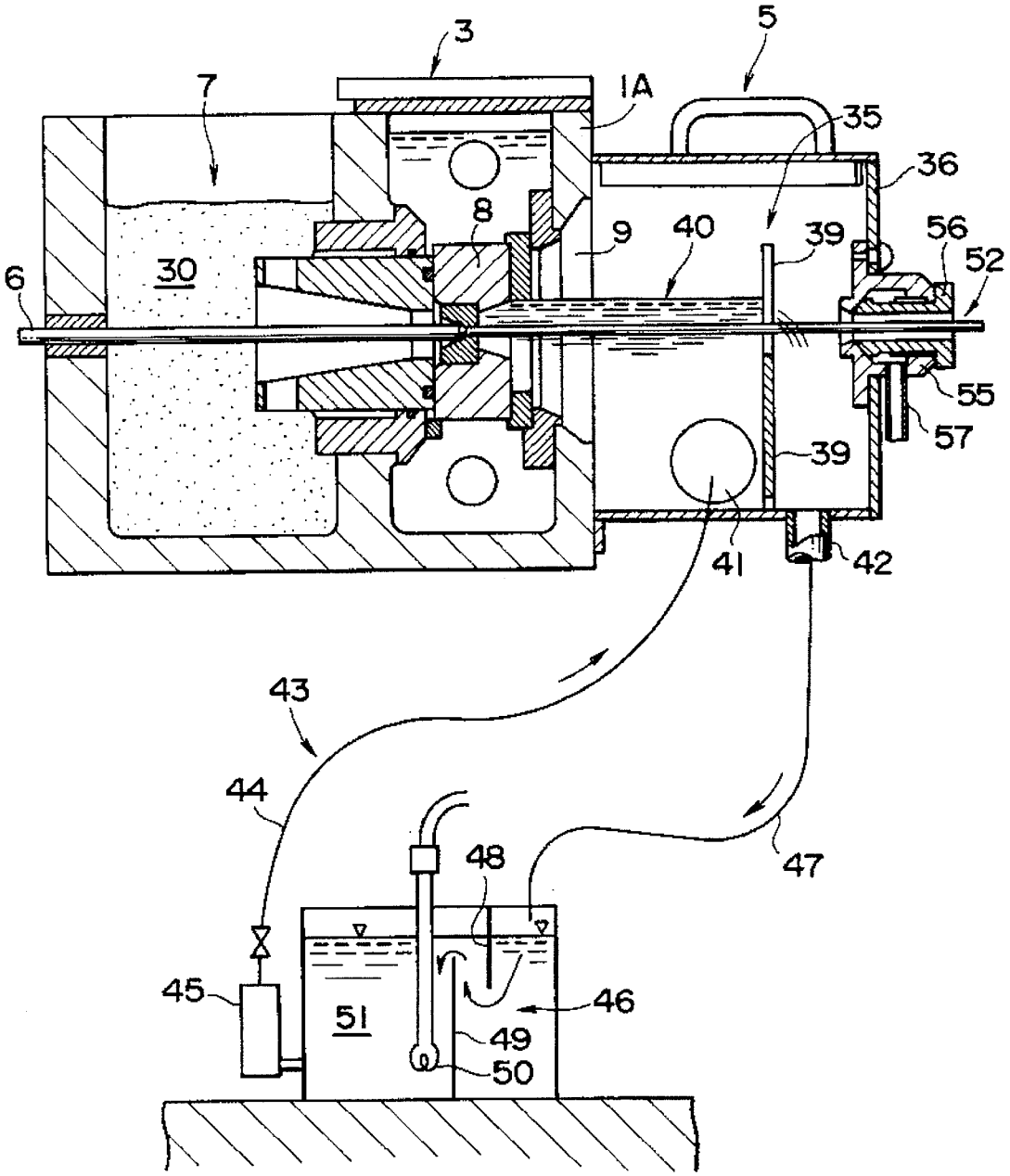
FIG. 5 is a schematic sectional view showing a die unit and an intermediate coating unit according to a second embodiment of the present invention.

As shown in FIG. 5, in the wiping unit 52 comprises a wiper case 55 provided on a rear wall 36 of the coating liquid bath 35, and a wiper nozzle 56 is screwed to the case 55. A circular slit for blowing out a compression air is formed between the wiper case 55 and the wiper nozzle 56. A compression air supply pipe 57 is connected to the wiper case 55. The amount of blow-out air can be controlled by turning the wiper nozzle 56 to adjust the width of the slit.

Figure 6:
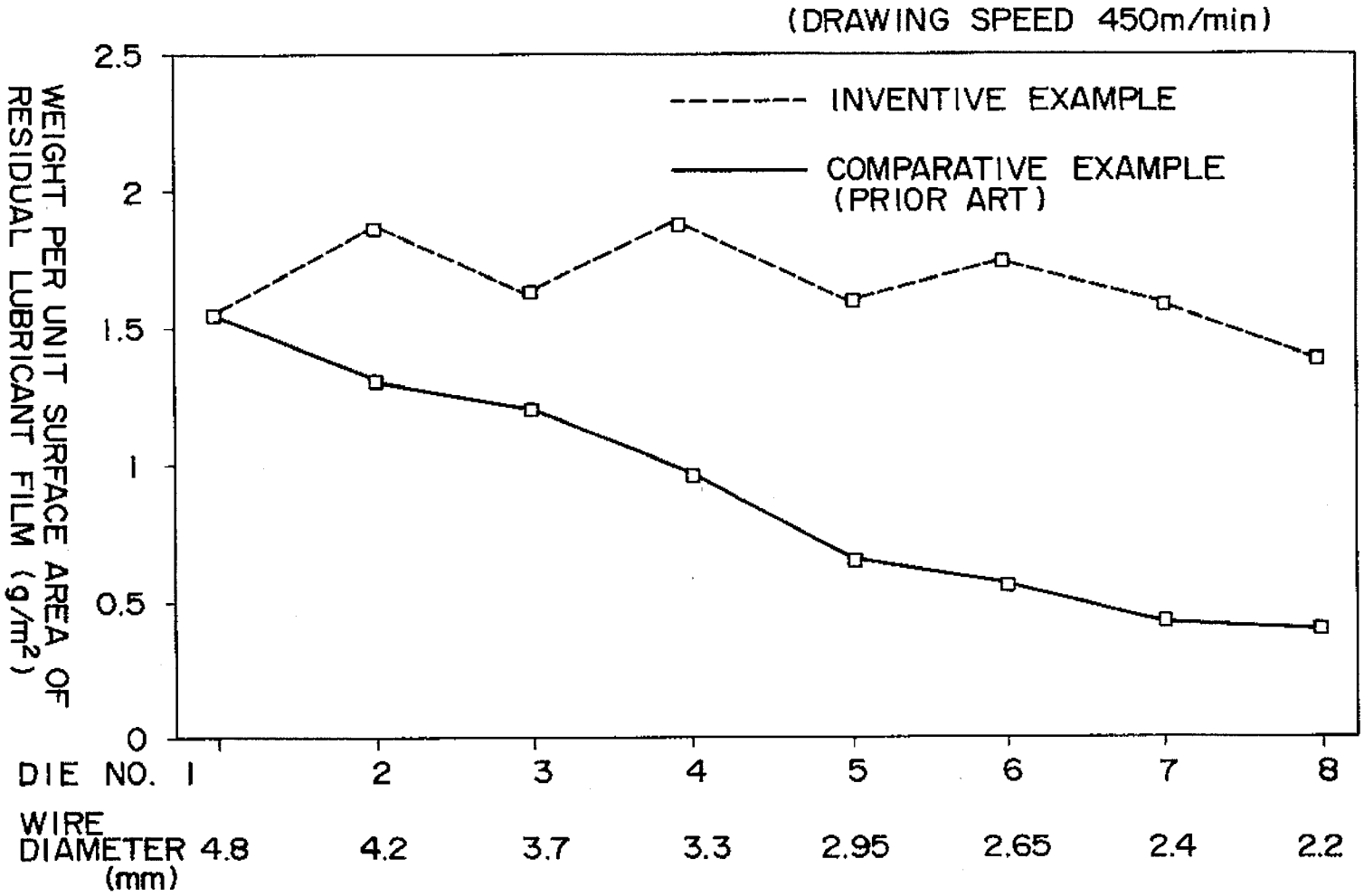
FIG. 6 is a view for comparing the present invention with the prior art with regard to the amount of residual lubricant film.

Experiments were made using this apparatus under the following conditions for confirming the effect of the present invention compared with the prior art, which gave the results shown in Table 2 and FIG. 6.

(Experimental Condition)

Kind of Steel: 0.82C carbon steel

Starting Wire Diameter: 5.5 mmø → Finished Wire Diameter: 2.2 mmø

Drawing Pre-treatment: mechanical descaling+ borax coating

Lubricant: Na based dry lubricant

Number of Die Units: 8 (No. 1 to No. 8)

Drawing Speed: 400 to 700 m/min

Inventive Example: intermediate coating unit, located at outlet of Die Units Nos. 2, 4 and 6

Comparative Example (Prior Art): intermediate coating not applied

TABLE 2

| Drawing speed (m/min) | 400 | 450 | 500 | 550 | 600 | 650 | 700 |
|---|---|---|---|---|---|---|---|
| Comparative example | ○ | Δ | X | X | X | X | X |
| Inventive example | ○ | ○ | ○ | ○ | ○ | ○ | ○ |

In the Table 2, ○ represents the absence of any seizure of the die; Δ represents the presence of a very slight seizure of the die; and X represents the presence of a seizure of the die.

As is apparent from FIG. 6, in the comparative example (prior art), the amount of the coating film containing residual lubricant was sequentially reduced as the number of passing of the wire 6 through the die 8 was increased, and it become about 0.5 g/m$^2$ at each of Die Unit Nos. 7 and 8. As a result, at each of Die Unit Nos. 7 and 8, slight seizure of the die was generated. On the contrary, in the inventive example, the amount of the coating film containing the residual lubricant remained to a sufficient extent and there was no seizure of the die at the same drawing speed.

As is apparent from Table 2, the drawing speed in the inventive example was extremely increased as compared with that in the comparative example (prior art). Consequently, a further increase the drawing speed can be expected by adopting the intermediate coating process at all of the spaces between adjacent die units.

Embodiment 3

Figure 7:
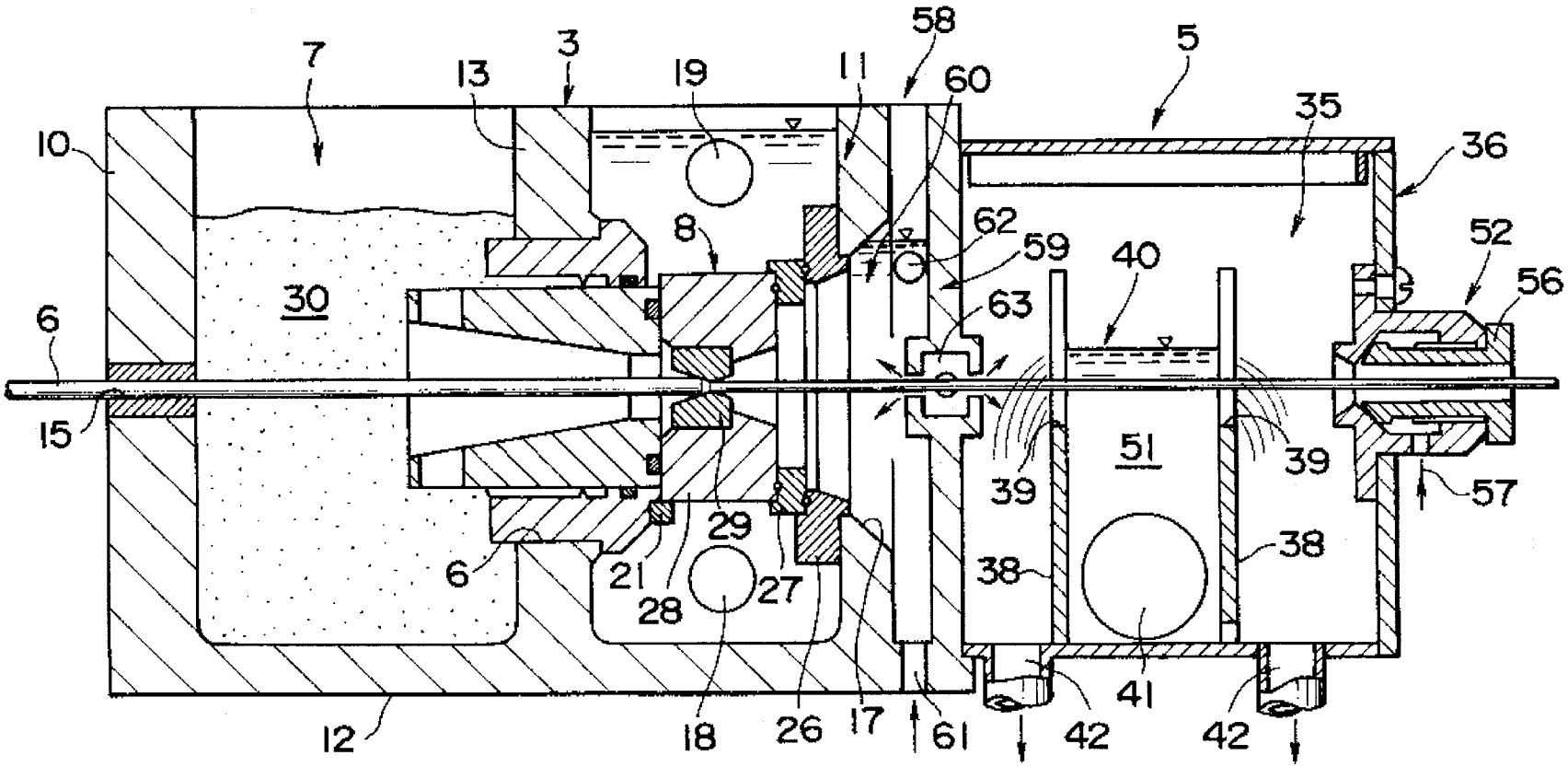
FIG. 7 is a schematic sectional view showing a die unit and an intermediate coating unit of a third embodiment of the present invention.

FIG. 7 shows a third embodiment of the present invention, which is different from the first and second embodiments shown in FIGS. 2, 3 and 5 in that a cooling unit 58 is provided at the outlet side of a die unit 3. An intermediate coating unit 5 is provided on the downstream side of the cooling unit 58 of the specified die unit 3.

A cooling chamber wall 59 is provided on the downstream side of a rear wall 11 of the die holder 9, and a cooling water chamber 60 is provided between the cooling chamber wall 59 and the rear wall 11, thus forming the cooling unit 58. A cooling water inlet 61 is provided on the lower portion of the cooling water chamber 60, and a cooling water outlet 62 is provided on the upper portion thereof. A metal wire passing hole is formed in the cooling chamber wall 59, and an air seal 63 is provided in the metal wire passing hole for preventing the mixing of the cooling water and a coating liquid 51.

The intermediate coating unit 5 is provided on the downstream side of the cooling chamber wall 59, and comprises a coating liquid dipping bath 35. The dipping bath 35 has a pair of front and rear bulkheads 38 and 38. The coating liquid 51 is stored between the bulkheads 38 and 38. Otherwise it has the same construction as that of the intermediate coating unit 5 shown in FIG. 5.

In this embodiment, the metal wire 6 is directly cooled by the cooling unit 58 directly after being drawn through the die 8. The wire 6 then passes through the coating liquid 51 to have with the pre-treatment coating film for subsequent drawing formed thereupon.

Since the metal wire 6 directly after being drawn through the die 8 passes through the cooling water, any flakes of lubricant stuck on the metal wire 6 fall off in the cooling water. As a result, the amount of the flakes carried into the coating liquid dipping bath 35 provided on the downstream side is extremely reduced.

Accordingly, the contamination of the coating liquid 51 is reduced, so that the maintenance of the coating liquid 51 is facilitated. In addition, the flakes of lubricant which had fallen off in the cooling water chamber 60 are discharged from the cooling water outlet 62 and suitably recovered.

Embodiment 4

Figure 8:
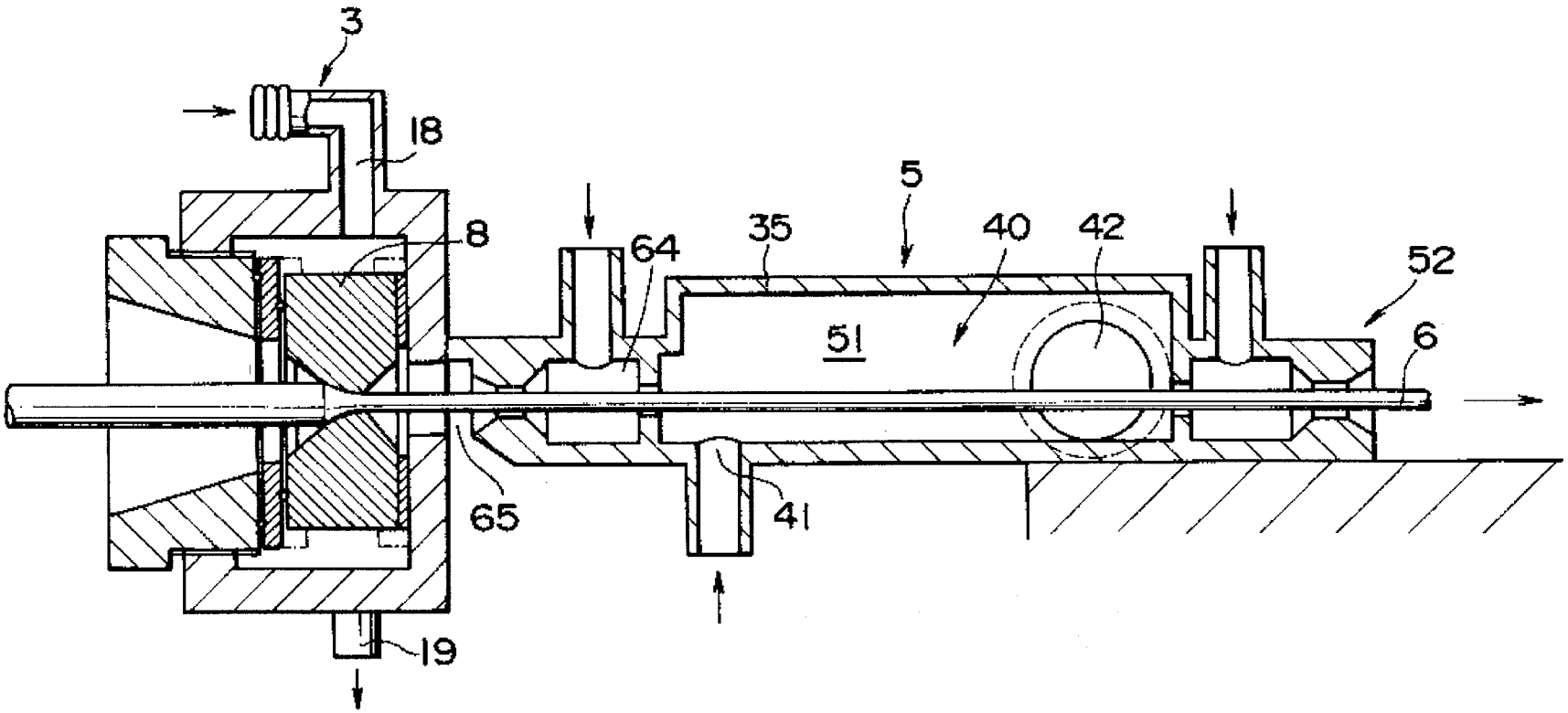
FIG. 8 is a schematic sectional view showing a die unit and an intermediate coating unit of a fourth embodiment of the present invention.

FIG. 8 shows the fourth embodiment. Like the third embodiment shown in FIG. 7, in this embodiment, a coating liquid dipping bath 35 is provided at a certain distance downstream of the outlet of the die 8. However, this embodiment is different from the third embodiment in that there is no cooling unit 58 for cooling the metal wire 6 provided.

The coating liquid dipping bath 35 in this embodiment has a coating liquid chamber 40. An air seal chamber 64 is formed on the front side of the front wall of the coating liquid chamber 40. An air wiping unit 52 is provided on the downstream side of the rear wall. A gap 65 through which flakes of lubricant may drop is formed between the outlet of the die 8 and the air seal chamber 64.

According to this embodiment, it becomes possible to prevent the entrapment of the flake of lubricant in the coating liquid chamber 40, and hence to facilitate the maintenance of the coating liquid 51.

Embodiment 5

Figure 9:
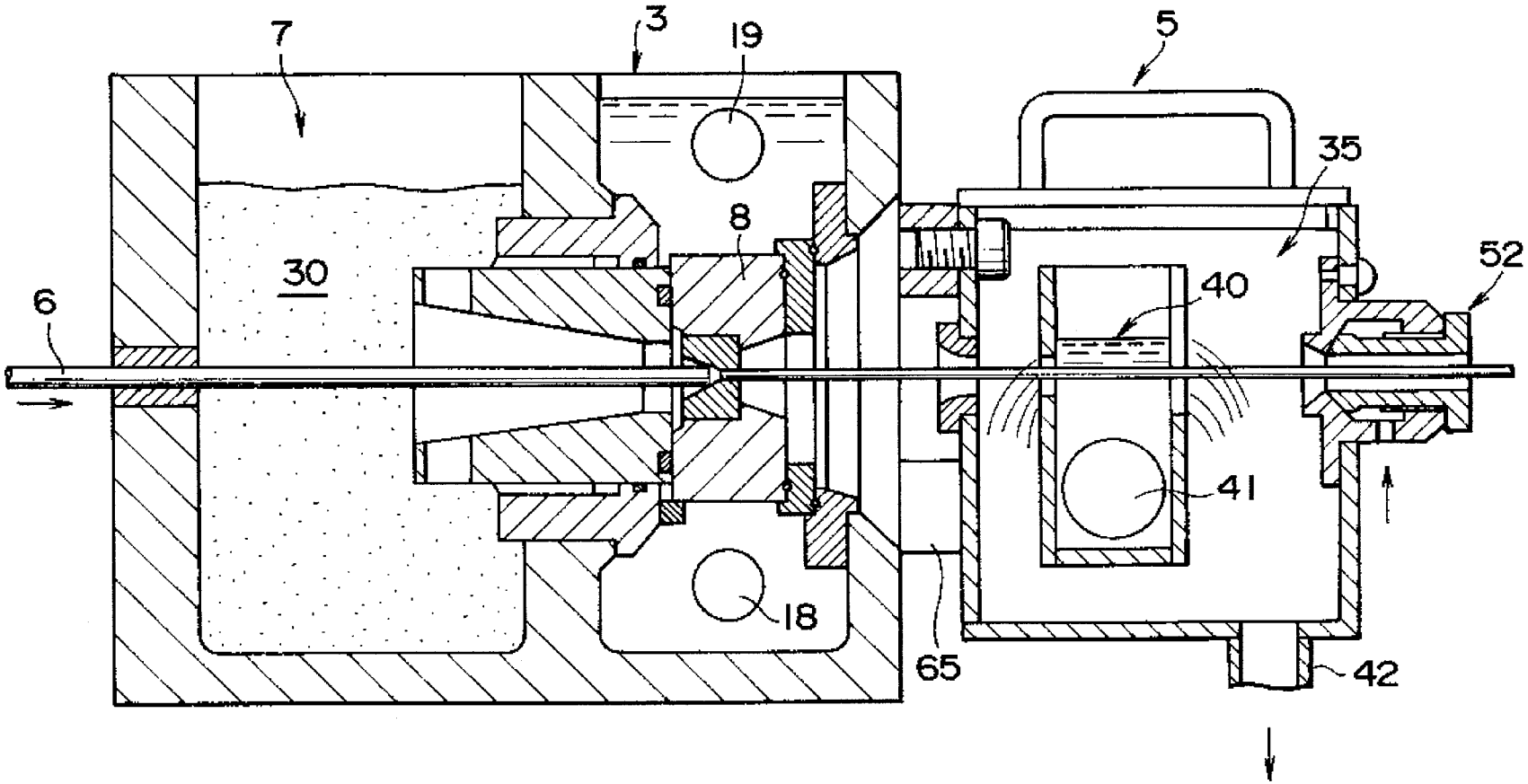
FIG. 9 is a schematic sectional view showing a die unit and an intermediate coating unit of a fifth embodiment of the present invention.

FIG. 9 shows the fifth embodiment, wherein a coating liquid dipping bath 35 is provided at a specified distance downstream of the outlet of the die 8. Otherwise it has the same basic construction as that of the fourth embodiment shown in FIG. 8.

According to this embodiment, it becomes possible to prevent the entrapment of flakes of lubricant in the coating liquid chamber 40, and hence to facilitate the maintenance of the coating liquid 51.

Moreover, in the fourth and fifth embodiments shown in FIGS. 8 and 9, the cooling effect of the metal wire 6 is lower than that in the third embodiment shown in FIG. 7; however, since the temperature of the metal wire 6 is higher and the ability of drying the coating liquid applied on the metal wire 6 is increased, and it is thus possible to form a thicker film.

Embodiment 6

Figure 10:
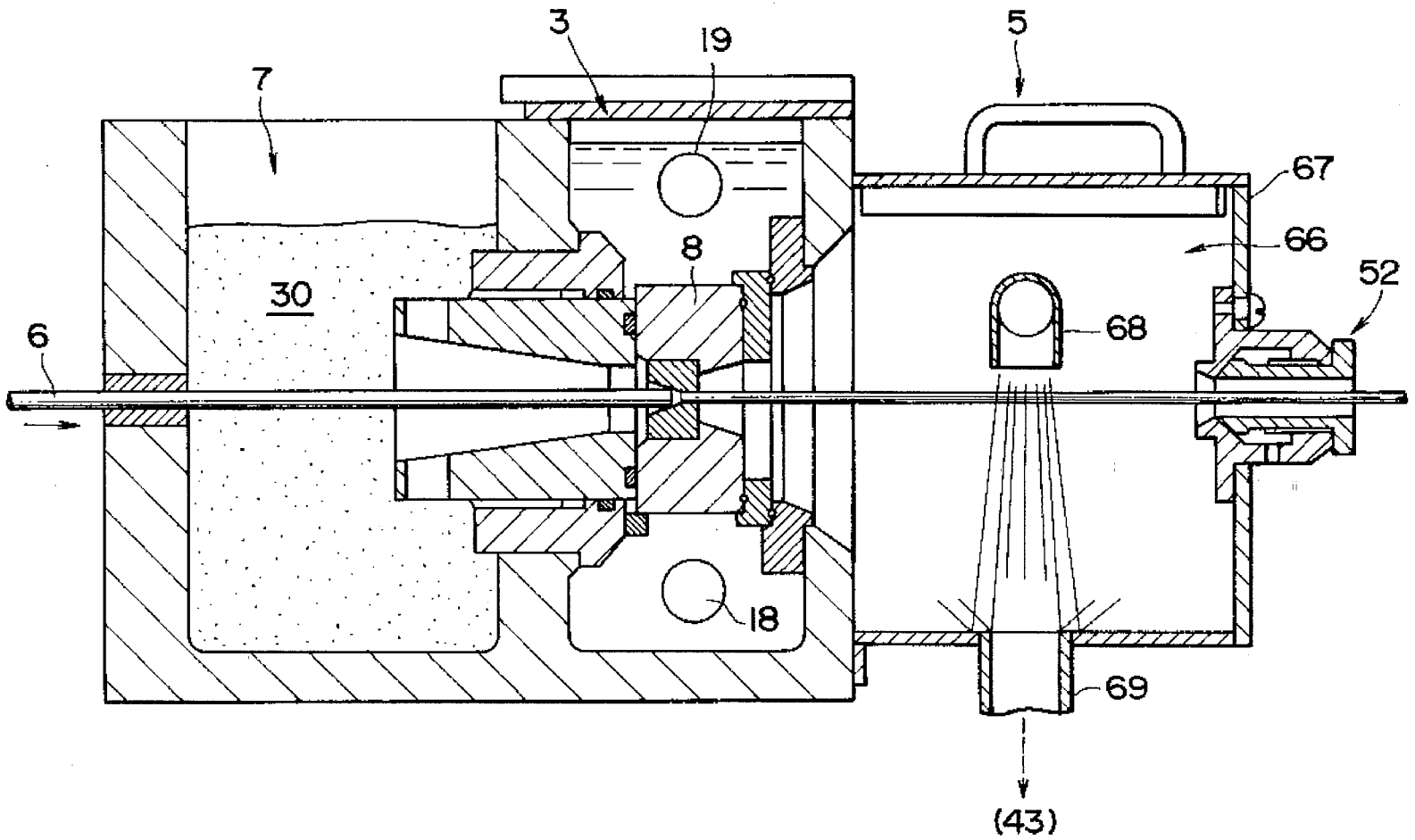
FIG. 10 is a schematic sectional view showing a die unit and an intermediate coating unit of a sixth embodiment of the present invention.
Figure 11:
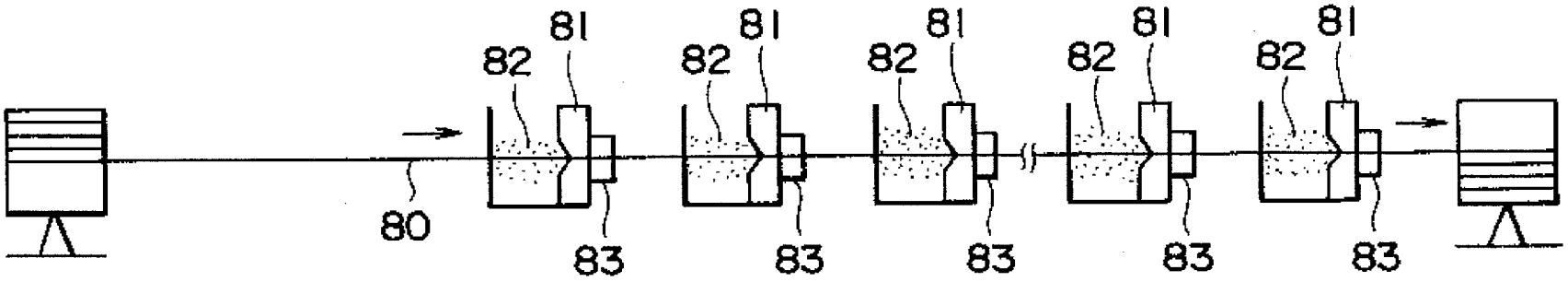
FIG. 11 PRIOR ART
FIG. 11 is a view showing the whole construction of a prior art continuous dry drawing apparatus.

FIG. 10 shows the sixth embodiment of the present invention, wherein the coating liquid dipping bath 35 of the intermediate coating unit 5 in the previous embodiments is replaced by a coating liquid spraying unit 66 for spraying the coating liquid onto the metal wire.

The coating liquid spraying unit 66 has a box body 67 mounted on a rear wall 11 of a die holder 9. A flow-out port 68 for spraying an intermediate liquid 51 to the metal wire 6 is provided on the upper portion of the box body 67, and a coating liquid discharge port 69 is provided on the bottom portion of the box body 67. The coating liquid circulating/supplying unit 43 is connected to the flow-out port 68 and the discharge port 69. A wiping unit 52 is provided on the rear wall of the box body 67.

In addition, the coating liquid flow-out port 68 may be provided on the right, left, or lower side of the metal wire 6, other than on the upper side of the metal wire 6.

The present invention is not limited to the above-described embodiments. For example, in a process of drawing using a mechanical descaler, an otherwise essential inline electrolytic pickling can be omitted by use of the present invention. The reason for this is as follows: namely, the present invention makes it possible to reinforce a coating film and improve the picking-up of lubricant, and thus to sufficiently obtain a specified drawing speed without the need to effect an etching finish by electrolytic pickling. Specifically, the wire after passing through the mechanical descaler has a smooth surface, and therefore, for example in the case of a high carbon wire for a steel cord, the wire is usually subjected to etching by electrolytic pickling for improving the ability of carrying lubricant to a die. The electrolytic pickling equipment requires a large space and has a high running cost. The coating film forming process of the present invention can sufficiently improve the ability of carrying lubricant to a die, and therefore, it can be used in place of the electrolytic pickling method.

Of all the commercially available processes, a phosphate treatment is known as a process for obtaining a lubricating film having the best performance. However, the process is relatively high in cost, and furthermore it is inconvenient in that sludge generated during processing must be discarded as industrial waste. If instead of this phosphate treatment, the intermediate coating process of the present invention is used to reinforce the coating film and thus improve the picking-up of lubricant by the metal wire, it is possible to achieve results better than those achieved with the prior-art methods. Furthermore, it is also possible to eliminate pickling process which creates industrial waste and thus provide a drawing process of a more mechanical nature.

In the present invention; it is most effective to provide an intermediate coating unit at the outlet of each of a plurality of dies, or at the outlet of at least that die directly before the die in which a lubricating film becomes thin and at which there is a fear of causing the seizure of the die.

As for the wiping unit, it is not limited to the type using air. A type using another gas may be used; and it may also be performed using a material such as felt or rubber.

What is claimed is:

1. A continuous dry drawing method of drawing a metal wire to a specified diameter comprising the steps of:

passing said metal wire through a plurality of die units disposed in series, each of said die units being composed of a dry lubricant unit for applying a dry lubricant on the surface of said metal wire, and a die provided on the downstream side of said dry lubricant unit; and subjecting said metal wire to an intermediate coating process for forming a coating film on the surface of said metal wire in at least one of the spaces between adjacent die units for enhancing the picking-up of a dry lubricant for subsequent drawing.

2. The continuous dry drawing method according to claim 1, wherein said intermediate coating process comprises the steps of:

applying a coating liquid on the surface of said metal wire; and then drying the coating liquid applied on said metal wire.

3. The continuous dry drawing method according to claim 1, wherein said intermediate coating process for forming a coating film on the surface of said metal wire is performed directly after passing said metal wire through said die.

4. The continuous dry drawing method according to claim 1, wherein said intermediate coating process for forming a coating film on the surface of said metal wire is performed at a specified distance downstream of said die.

5. The continuous dry drawing method according to claim 1, further comprising the step of cooling said metal wire before performing said intermediate coating process for forming a coating film on said metal wire.

6. The continuous dry drawing method according to claim 1, further comprising the step of wiping said metal wire after said intermediate coating process for forming a coating film on the surface of said metal wire, such that the thickness of the coating film applied on the surface of said metal wire is made uniform.

7. The continuous dry drawing method according to claim 2, wherein said step of applying the coating liquid is performed by passing said metal wire through said coating liquid.

8. The continuous dry drawing method according to claim 2, wherein said step of applying the coating liquid is performed by spraying said coating liquid on the surface of said metal wire.

9. The continuous dry drawing method according to claim 2, wherein said step of drying said coating liquid applied to said metal wire is performed using the working heat of the metal wire itself.

10. The continuous dry drawing method according to claim 2, wherein said coating film is formed from a solution mainly containing a water-soluble inorganic salt.

11. A continuous dry drawing method according to claim 10, including the step of circulating said solution.

12. A continuous dry drawing apparatus for drawing a metal wire to a specified diameter comprising:

a plurality of die units disposed in a series, each of said die units comprising a dry lubricant unit for applying a dry lubricant onto the surface of said metal wire, and a die provided on the downstream side of said dry lubricant unit; and an intermediate coating unit provided in at least one of the spaces between adjacent die units for forming a coating film on the surface of said metal wire for enhancing the picking-up of a dry lubricant for subsequent die-drawing.

13. The continuous dry drawing apparatus according to claim 12, wherein said intermediate coating unit comprises a coating liquid dipping bath through which said metal wire may pass.

14. The continuous dry drawing apparatus according to claim 12, wherein said intermediate coating unit comprises a coating liquid spraying unit for spraying the coating liquid on the surface of said metal wire.

15. The continuous dry drawing apparatus according to claim 12, wherein said intermediate coating unit is provided at a specified distance downstream of said die unit.

16. The continuous dry drawing apparatus according to claim 12, further comprising a wiping unit provided downstream of said intermediate coating unit, for wiping said metal wire such that the thickness of the coating liquid on the surface of said metal wire is made uniform.

17. The continuous dry drawing apparatus according to claim 12, wherein said intermediate coating unit is connected to a coating liquid circulating/supplying unit for circulating and supplying said coating liquid.

18. The continuous dry drawing apparatus according to claim 13, wherein said coating liquid dipping bath is provided directly adjacent to the outlet of said die unit.

19. The continuous dry drawing apparatus according to claim 15, further comprising a cooling unit for cooling said metal wire provided between the outlet of said die unit and said intermediate coating unit.

* * * * *